US011131513B2

(12) United States Patent
Rasmussen

(10) Patent No.: US 11,131,513 B2
(45) Date of Patent: Sep. 28, 2021

(54) ATTACHMENT MEANS, GASKET ARRANGEMENT, HEAT EXCHANGER PLATE AND ASSEMBLY

(71) Applicant: ALFA LAVAL CORPORATE AB, Lund (SE)

(72) Inventor: Jenny Rasmussen, Malmö (SE)

(73) Assignee: ALFA LAVAL CORPORATE AB, Lund (SE)

( * ) Notice: Subject to any disclaimer, the term of this patent is extended or adjusted under 35 U.S.C. 154(b) by 146 days.

(21) Appl. No.: 16/563,574

(22) Filed: Sep. 6, 2019

(65) Prior Publication Data

US 2019/0390923 A1 Dec. 26, 2019

Related U.S. Application Data

(62) Division of application No. 15/036,044, filed as application No. PCT/EP2014/076187 on Dec. 2, 2014, now Pat. No. 10,451,361.

(30) Foreign Application Priority Data

Dec. 18, 2013 (EP) ..... 13198066

(51) Int. Cl.

| | |
|---|---|
| ***F28F 3/10*** | (2006.01) |
| ***F28D 9/00*** | (2006.01) |
| ***F28F 3/08*** | (2006.01) |

(52) U.S. Cl.

CPC ..... *F28F 3/10* (2013.01); *F28D 9/0093* (2013.01); *F28D 9/0006* (2013.01); *F28F 3/08* (2013.01)

(58) Field of Classification Search

CPC .. F28F 3/10; F28F 3/08; F28D 9/0093; F28D 9/0006

See application file for complete search history.

(56) References Cited

U.S. PATENT DOCUMENTS

| | | | |
|---|---|---|---|
| 4,635,715 | A | 1/1987 | Andersson |
| 4,905,758 | A | 3/1990 | Mathur et al. |

(Continued)

FOREIGN PATENT DOCUMENTS

| | | | |
|---|---|---|---|
| DE | 100 35 776 | C1 | 12/2001 |
| EP | 0762071 | A1 | 3/1997 |

(Continued)

OTHER PUBLICATIONS

English translation of Russian Notice of Allowance issued in Russian Application No. 2016128885, dated Nov. 16, 2017.

(Continued)

*Primary Examiner* — Jon T. Schermerhorn, Jr.

(74) *Attorney, Agent, or Firm* — Birch, Stewart, Kolasch & Birch LLP

(57) ABSTRACT

A connector, a gasket arrangement, a heat exchanger plate and an assembly are provided. The connector is arranged to engage with an edge portion of the heat exchanger plate for fastening a gasket to a first side of the heat exchanger plate. The connector includes a first connection member, a second connection member and a bridge. A first part of the first connection member is arranged to engage with the gasket and a second part of the first connection member engages with the bridge. A first part of the second connection member is arranged to engage with the gasket and a second part of the second connection member engages with the bridge. The connector includes a finger arranged between the first and second connection members, a connection part of the finger engaging which the bridge and the finger being arranged to extend from the bridge towards the gasket. The connector is characterized in that the finger has a width that is varying along a length of the finger, a width extension of the finger being parallel to a length extension of the bridge.

3 Claims, 5 Drawing Sheets

(56) References Cited

U.S. PATENT DOCUMENTS

| | | | |
|---|---|---|---|
| 5,727,620 | A | 3/1998 | Schäufele et al. |
| 5,927,395 | A | 7/1999 | Damiani |
| 5,988,268 | A | 11/1999 | Usami et al. |
| 6,186,224 | B1 | 2/2001 | Seidel |
| 7,424,908 | B2 | 9/2008 | Blomgren |
| 9,217,608 | B2 | 12/2015 | Krantz et al. |
| 2002/0074112 | A1 | 6/2002 | Lehmann et al. |

FOREIGN PATENT DOCUMENTS

| | | | |
|---|---|---|---|
| JP | 60-501568 | A | 9/1985 |
| JP | 3-263594 | A | 11/1991 |
| JP | 8-271178 | A | 10/1996 |
| JP | 2000-97583 | A | 4/2000 |
| JP | 2002-519614 | A | 7/2002 |
| JP | 2003-502611 | A | 1/2003 |
| JP | 2012-512382 | A | 5/2012 |
| RU | 2445566 | C1 | 3/2012 |
| WO | WO 85/00052 | A1 | 1/1985 |
| WO | WO 91/13310 | A1 | 9/1991 |
| WO | WO 99/67589 | A2 | 12/1999 |
| WO | WO 00/77468 | A1 | 12/2000 |
| WO | WO 2009/080692 | A1 | 7/2009 |
| WO | WO 2010/071551 | A2 | 6/2010 |
| WO | WO 2010/092556 | A1 | 8/2010 |

OTHER PUBLICATIONS

Japanese Office Action and English translation thereof, dated May 22, 2017, for Japanese Application No. 2016-541198.

ATTACHMENT MEANS, GASKET ARRANGEMENT, HEAT EXCHANGER PLATE AND ASSEMBLY

CROSS-REFERENCE TO RELATED APPLICATIONS

This application is a Divisional of copending application Ser. No. 15/036,044, filed on May 11, 2016, which is the National Phase under 35 U.S.C. § 371 of International Application No. PCT/EP2014/076187, filed on Dec. 2, 2017, which claims priority under 35 u.s.c. § 119(a) to application Ser. No. 13/198,066.6, filed in Europe on Dec. 18, 2013, all of which are hereby expressly incorporated by reference into the present application

TECHNICAL FIELD

The invention relates to an attachment means arranged to engage with an edge portion of a heat exchanger plate for fastening a gasket to a first side of the heat exchanger plate. The invention also relates to a gasket arrangement comprising such a gasket and such an attachment means. Further, the invention relates to a heat exchanger plate and an assembly comprising such a heat exchanger plate, such a gasket and such an attachment means.

BACKGROUND ART

Plate heat exchangers, PHEs, typically consist of two end plates in between which a number of heat exchanger plates are arranged in an aligned manner, i.e. in a stack. In one type of well-known PHEs, the so called gasketed PHEs, gaskets are arranged between the heat exchanger plates, typically in gasket grooves which extend along edges of the heat exchanger plates. The end plates, and therefore the heat exchanger plates, are pressed towards each other whereby the gaskets seal between the heat exchanger plates. The gaskets define parallel flow channels between the heat exchanger plates through which channels two fluids of initially different temperatures alternately can flow for transferring heat from one fluid to the other. In order for the channels not to leak it is naturally essential that the gaskets are properly positioned between the plates.

When the plate heat exchanger is closed, the gaskets are squeezed between the plates and thereby securely held in place. However, when the gaskets are not squeezed between the plates, such as when the plate heat exchanger is assembled or open for maintenance, some kind of means for fixing the gaskets correctly to the plates is desirable. It is known to use some kind of adhesive means, such as glue or tape, for fixing the gaskets to the plates. However, attaching the gaskets by adhesive is relatively time-consuming and therefore expensive. Further, fixing by adhesive may negatively affect the gaskets and their sealing capacity. Also mechanical gasket fixing solutions are previously known, for example through applicant's own U.S. Pat. No. 4,635,715. This document discloses different embodiments of gaskets provided with projections for securing the gaskets to heat exchanger plates. The gaskets described herein may be difficult to handle, more particularly, relatively prone to tangling in that the projections may get stuck in each other or in other objects. Further, these gaskets may provide relatively unreliable fastening to the heat exchanger plates in that the engagement between the projections and the heat exchanger plates is relatively weak with a risk of the projections "sliding off" the heat exchanger plate.

SUMMARY

An object of the present invention is to provide an attachment means for fastening a gasket to a heat exchanger plate that provides a more reliable gasket fastening and more easy gasket handling as compared to prior art. The basic concept of the invention is construct the attachment means with at least one enclosed finger arranged to "self-lock" in the heat exchanger plate. Other objects of the present invention is to provide a gasket arrangement comprising such a gasket and such an attachment means, a heat exchanger plate and an assembly comprising such a heat exchanger plate, such a gasket and such an attachment means.

The attachment means, gasket arrangement, heat exchanger plate and assembly for achieving the objects above are defined in the appended claims and discussed below.

An attachment means according to the present invention is arranged to engage with an edge portion of a heat exchanger plate for fastening a gasket to a first side of the heat exchanger plate. It comprises a first connection member, a second connection member and a bridge. A first part of the first connection member is arranged to engage with the gasket and a second part of the first connection member engages with the bridge. Similarly, a first part of the second connection member is arranged to engage with the gasket and a second part of the second connection member engages with the bridge. The attachment means further comprises a finger arranged between the first and second connection members. A connection part of the finger engages with the bridge and the finger is arranged to extend from the bridge towards the gasket. The attachment means is characterized in that the finger has a width that is varying along a length of the finger, wherein a width extension of the finger is parallel to a length extension of the bridge.

Since the finger is enclosed by a frame formed by the first and second connection members together with the bridge, the risk of the finger accidentally getting stuck somewhere is relatively small. The frame construction is also beneficial as regards the rigidity of the attachment means by comparison with a more "open" construction.

Typically, the edge portion of the heat exchanger plate is corrugated so as to comprise alternately arranged ridges and valleys, one of the ridges and valleys being arranged to receive the finger of the attachment means. Further, the finger and the ridge or valley arranged to receive the finger are typically essentially uniform and the finger fills up essentially the entire ridge or valley. Thus, by the finger having a varying width, mechanical interlocking between the attachment means and the edge portion of the heat exchanger plate may be enabled in a direction perpendicular to the width extension of the finger and parallel to an extension plane of the heat exchanger plate, whereby the attachment means may be firmly fixed to the heat exchanger plate.

The finger may have a first portion with a first width and a second portion with a second width, which first portion is arranged closer to the bridge than the second portion, and which first width is smaller than the second width. Thereby, when the attachment means engages properly with the heat exchanger plate, sliding of the attachment means in a direction parallel to the extension plane of the heat exchanger plate, and perpendicularly from an edge of the edge portion thereof, may be disabled.

A third portion of the finger may be tapered along the length of the finger in a direction towards the bridge. The third portion of the finger may be the entire finger whereby the finger is tapered along its complete length and the length decrease is continuous along the finger. Alternatively, the third portion of the finger may constitute only a part of the finger which then may be tapered along only this part of its length. In either case, a tapered finger may enable an attachment means that is relatively straight-forward to manufacture and apply onto the heat exchanger plate. From the reasoning above is clear that the third portion may comprise the first and/or the second portion of the finger, partially or completely.

At least one of the first and second connection members may have a width that is varying along a length of said at least one of the first and second connection members, wherein a width extension of said at least one of the first and second connection members is parallel to the length extension of the bridge. In accordance therewith, the attachment means may have a varying width, wherein a width extension of the attachment means is parallel to the length extension of the bridge. In the latter embodiments, the design of said at least one of the first and second connection members may be adapted to the design of the finger. Further, such embodiments may enable a relatively strong and stable attachment means capable of firm engagement with the heat exchanger plate.

The attachment means may be so constructed that each of the first and second connection members is arranged to engage with the first side of the heat exchanger plate while the finger is arranged to engage with a second opposite side of the heat exchanger plate. Thereby, the heat exchanger plate may be "pinched" between the first and second connection members and the finger whereby the attachment means may be firmly fixed to the heat exchanger plate.

A gasket arrangement according to the present invention comprises a gasket and an attachment means as described above.

A heat exchanger plate according to the present invention comprises, on a first side thereof, a gasket groove extending along an edge of the heat exchanger plate. An edge portion of the heat exchanger plate extends between the edge and the gasket groove and it is corrugated so as to comprise alternately arranged ridges and valleys as seen from the first side. The edge portion is arranged to engage with an attachment means for fastening a gasket in the gasket groove. A width extension of the ridges and valleys is parallel to a length extension of the gasket groove. The heat exchanger plate is characterized in that at least one of the ridges and valleys has a width that is varying along a length of said at least one of the ridges and valleys. A first portion of said at least one of the ridges and valleys has a first width and a second portion of said at least one of the ridges and valleys has a second width. The first portion is arranged closer to the gasket groove than the second portion, and the first width is larger than the second width.

The heat exchanger plate may be such that said at least one of the ridges and valleys is closed towards, or separated from, the gasket groove. By this is meant that said at least one of the ridges and valleys, or more particularly the space defined by said at least one of the ridges and valleys, is not in communication with the gasket groove. Thereby, a relatively straight-forward construction of the heat exchanger plate is enabled. In that said at least one of the ridges and valleys is closed towards the gasket groove, complete gasket support in an area of said at least one of the ridges and valley may be enabled.

Further, a third portion of said at least one of the ridges and valleys may be tapered along the length of said at least one of the ridges and valleys in a direction from the gasket groove. The third portion of the ridge or valley may be the entire ridge or valley, or it may constitute only a part of the ridge or valley. In either case, a tapered ridge or valley may enable a heat exchanger plate that is relatively straight-forward to manufacture and bring into engagement with the attachment means.

Said at least one of the ridges and valleys may be one of the ridges and at least one of the valleys may have a width that is varying along a length of said at least one of the valleys.

An assembly according to the present invention comprises a heat exchanger plate, a gasket and an attachment means as described above.

The above discussed advantageous of the different embodiments of the attachment means are transferable to the gasket arrangement, the heat exchanger plate and assembly.

Still other objectives, features, aspects and advantages of the invention will appear from the following detailed description as well as from the drawings.

BRIEF DESCRIPTION OF THE DRAWINGS

The invention will now be described in more detail with reference to the appended schematic drawings, in which.

DETAILED DESCRIPTION

Figure 1:
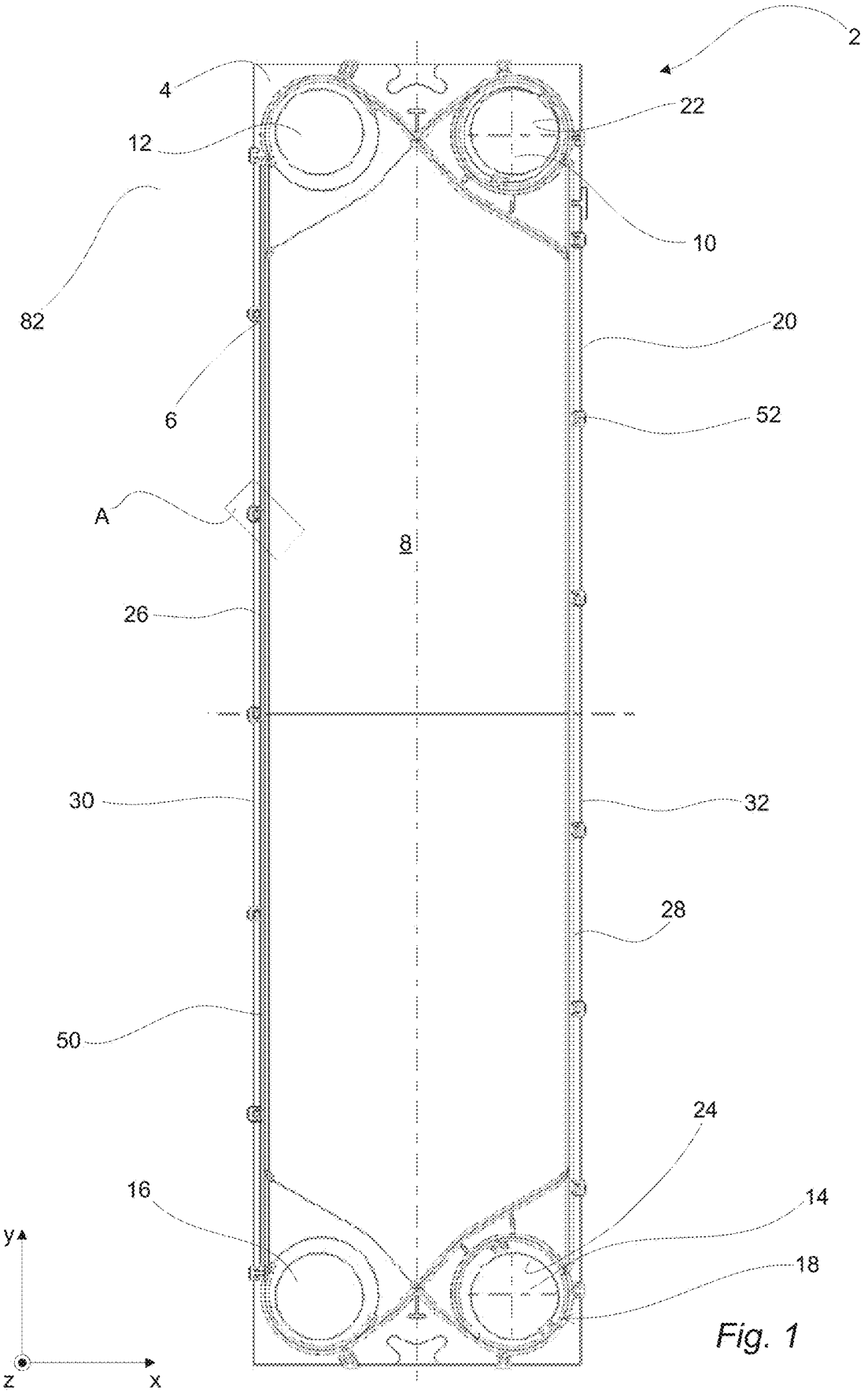
FIG. 1 is a plan view of an assembly comprising a heat exchanger plate and a gasket arrangement.
Figure 2:
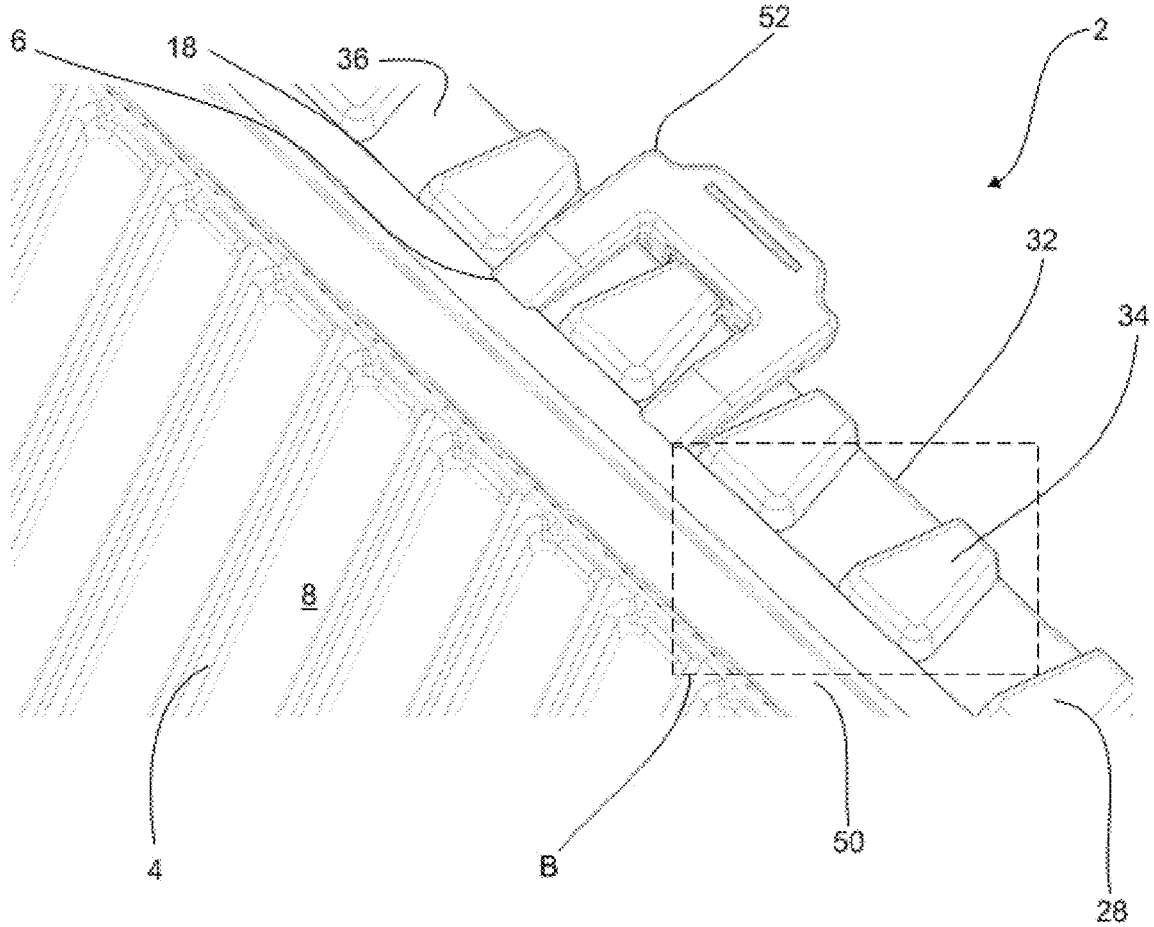
FIG. 2 is a partial enlargement of the assembly of FIG. 1.
Figure 3:
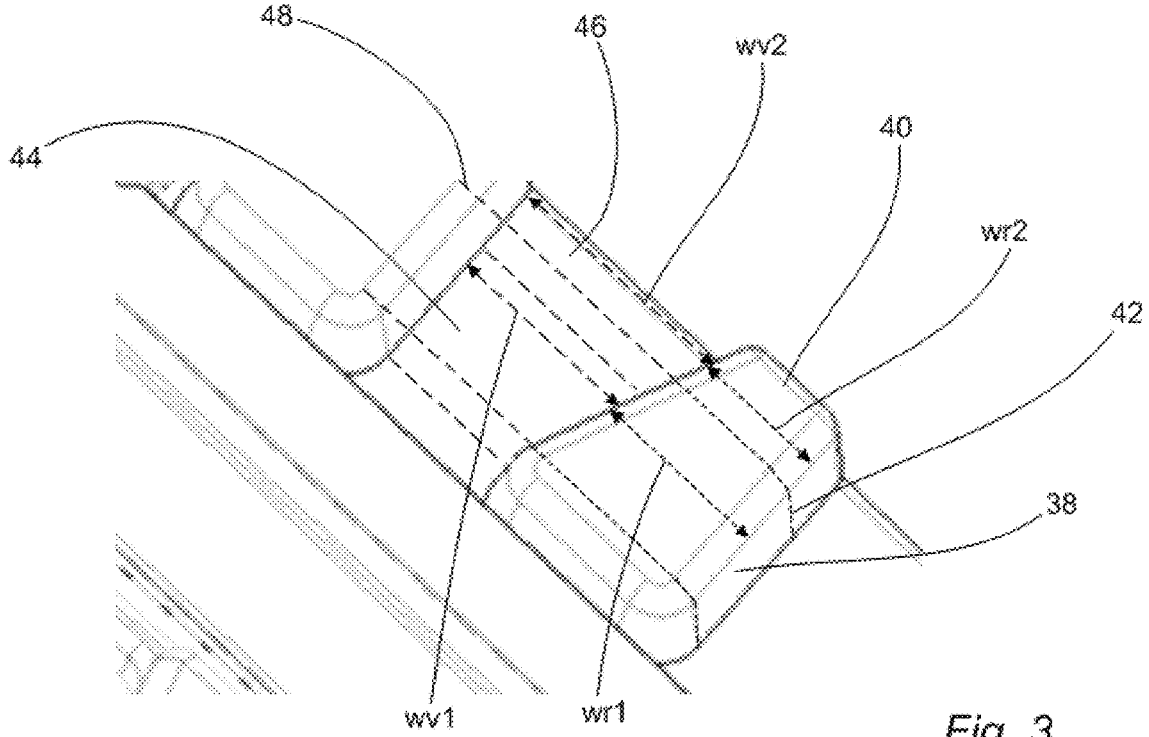
FIG. 3 is a partial further enlargement of the assembly of FIG. 1.
Figure 4:
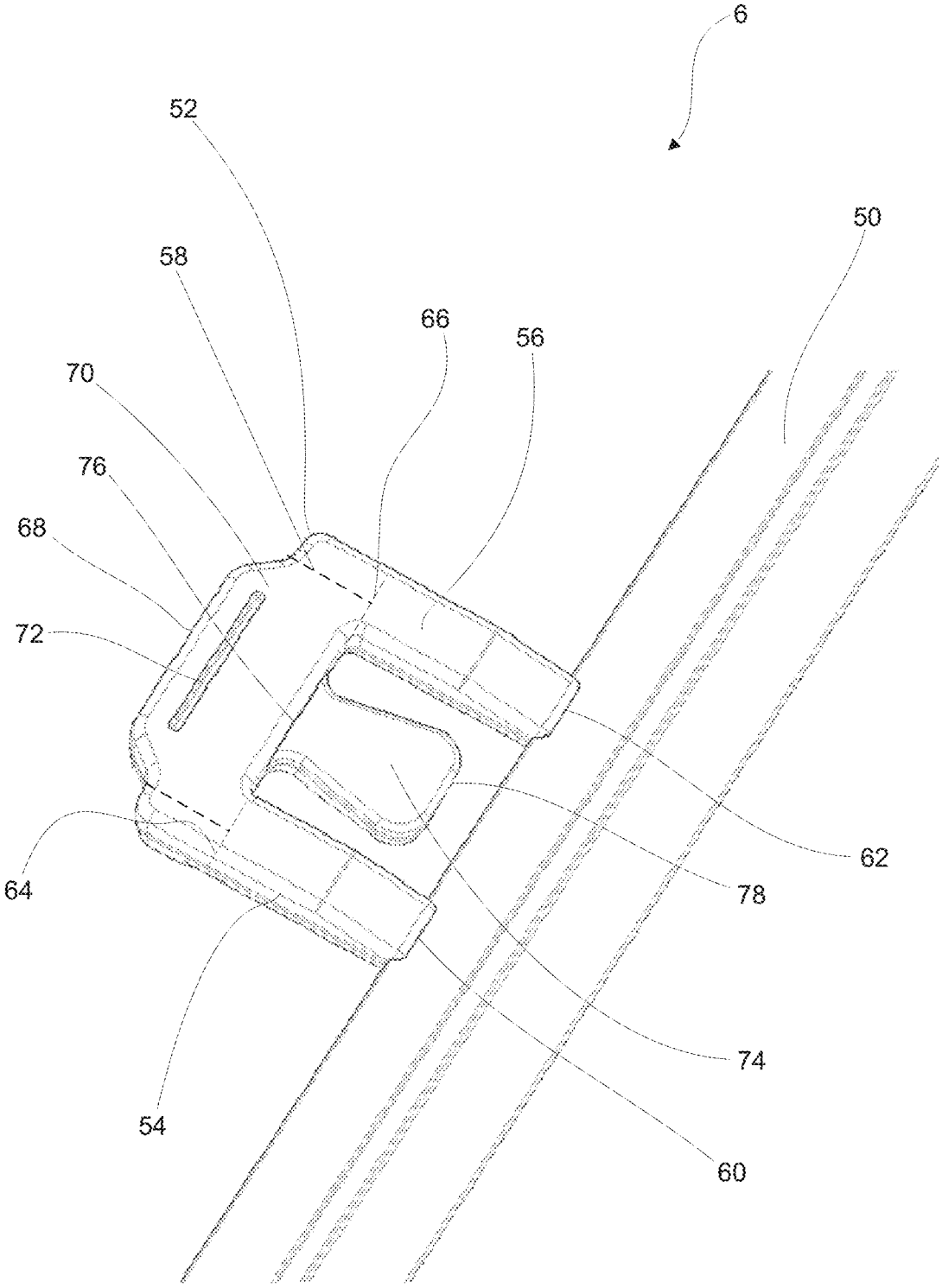
FIG. 4 is a partial enlargement of the gasket arrangement of the previous figures.

With reference to FIGS. 1, 2 and 3, an assembly 2 comprising a heat exchanger plate 4 and a gasket arrangement 6, is shown. FIG. 2 shows an enlargement of a part of the assembly enclosed by the dashed rectangle A in FIG. 1, and FIG. 3 shows an enlargement of a part of the assembly enclosed by the dashed rectangle B in FIG. 2. The heat exchanger plate 4, of which a first side 8 is visible in the figures, is an essentially rectangular sheet of stainless steel provided with a number of port holes 10, 12, 14 and 16, and pressed with specific patterns within different areas of the heat exchanger plate (illustrated partly in FIG. 2). The heat exchanger plate 4 comprises a gasket groove 18 extending along an outer plate periphery 20 to enclose the port holes 10, 12, 14 and 16, and completely along two inner plate peripheries 22 and 24 defining two of the port holes 10 and 14, respectively, to separately enclose these. Further, the gaskets groove 18 extends twice "diagonally" across the heat exchanger plate so as to further enclose the port holes 10 and 14. The heat exchanger plate 4 further comprises a first and a second length edge portion 26 and 28, respectively, extending between the gasket groove 18 and a first and a second length edge 30 and 32, respectively, of the heat exchanger plate 4. The edge portions 26 and 28 are corrugated so as to comprise alternately arranged ridges 34 and valleys 36 (FIGS. 2 and 3). The ridges 34 are closed towards the gasket groove 18 and arranged to provide gasket support.

With reference to the orthogonal system of coordinates in FIG. 1, the ridges 34 and valleys 36 illustrated in FIGS. 2 and 3 has a length extension in an x-direction, a width extension in an y-direction and a height/depth extension in a z-direction, while the part of the gasket groove 18 illustrated in FIGS. 2 and 3 has a length extension in the y-direction, a width extension in the x-direction and a thickness extension in the z-direction.

As is clear from the figures, the ridges 34, just like the valleys 36, have a width varying along a length of the ridges and valleys, respectively, i.e. along the x-direction. More particularly, each of the ridges 34 has a first portion 38 with a first varying width wr1 and a second portion 40 with a second varying width wr2. The first portion is closer to the gasket groove 18 than the second portion and the first portion is wider than the second portion, i.e. wr1>wr2. Each of the ridges 34 comprises a third portion 42, here composed of the first and second portions 38 and 40, which is tapered such that the width of the third portion is gradually increasing towards the gasket groove 18. Further, each of the valleys 36 has a first portion 44 with a first varying width wv1 and a second portion 46 with a second varying width wv2. The first portion is closer to the gasket groove 18 than the second portion and the second portion is wider than the first portion, i.e. wv2>wv1. Each of the valleys 36 comprises a third portion 48, here composed of the first and second portions 44 and 46, which is tapered such that the width of the third portion is gradually decreasing towards the gasket groove 18.

The gasket arrangement 6 comprises a rubber gasket 50 and a number of essentially similar rubber attachment means or connector 52 integrally formed with the gasket, one of these attachment means being illustrated in more detail in FIGS. 4 and 5*a*-5*d*. The attachment means 52 comprises a first connection member 54, a second connection member 56 and a bridge 58. The first and second connection members are essentially similar and they have a length just exceeding a width (extension in x-direction with reference to FIG. 1) of the first and second length edge portions 26 and 28.

A first part, more particularly a first end 60, of the first connection member 54 is connected to the gasket 50. Similarly, a first part, more particularly a first end 62, of the second connection member 56 is connected to the gasket 50. A second part, more particularly a second end 64, of the first connection member 54 is connected to the bridge 58. Similarly, a second part, more particularly a second end 66, of the second connection member 56 is connected to the bridge 58.

Figure 5A:
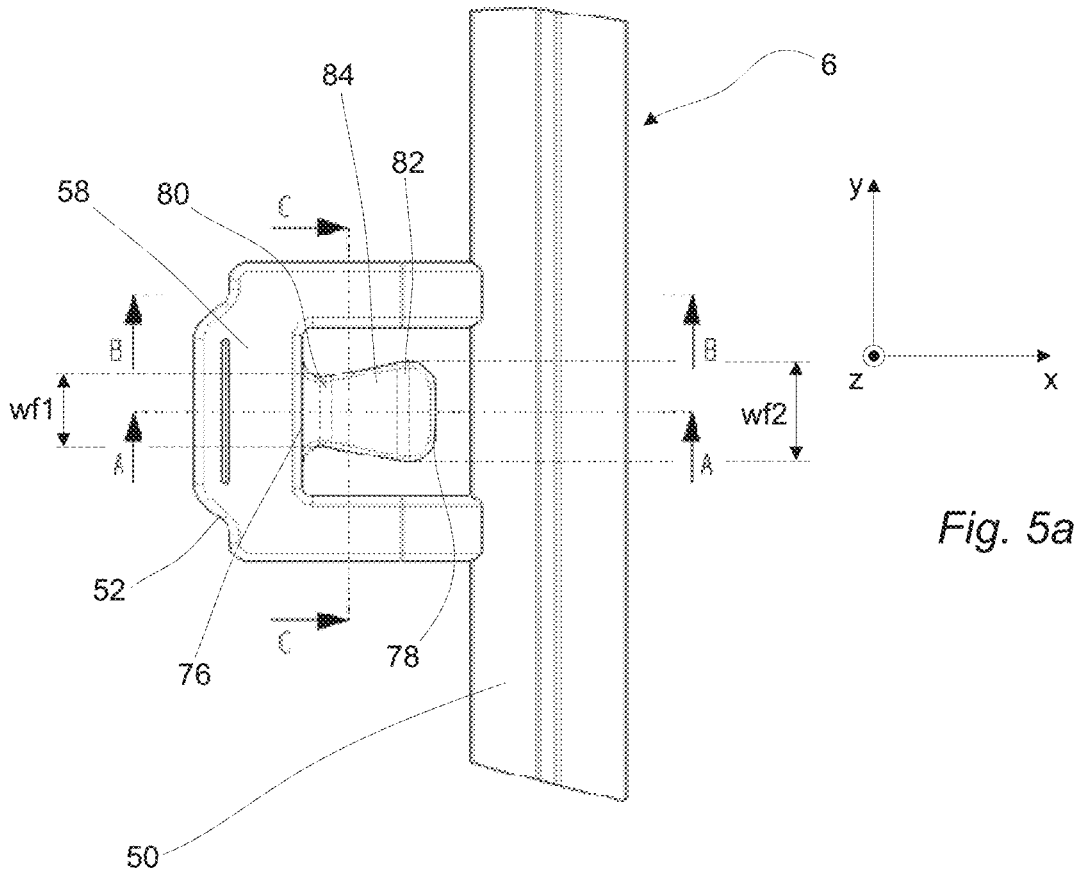
FIG. 5*a* is a partial plan view of the gasket arrangement of the previous figures.

The first and second connection members are separated from, and essentially parallel to, each other, and they project essentially perpendicularly from the gasket. As seen in FIG. 5*a*, the bridge has a length extension in the y-direction, a width extension in the x-direction and a thickness extension in the z-direction, while the first and second connection members have a length extension in the x-direction, a width extension in the y-direction and a thickness extension in the z-direction.

The bridge 58 extends essentially parallel to the gasket 50. It has a center portion 68 that is wider than the rest of the bridge and an upper surface 70 of the center portion is provided with a friction increasing structure in the form of an elongate projection 72 extending essentially parallel to the gasket, i.e. along the y-direction. This is to facilitate application of the gasket arrangement in connection with which the attachment means is grabbed by the bridge 58. The wider center portion also increases the rigidity of the bridge and thus the complete attachment means.

The attachment means 52 further comprises a finger 74 arranged between the first and second connection members 54 and 56. A connection part, more particularly a first end 76, of the finger 74 is connected to the bridge 58 while a second end 78 of the finger is free. The finger projects essentially perpendicularly from the bridge towards the gasket 50. Thus, the finger 74 has a length extension in the x-direction, a width extension in the y-direction and a thickness extension in the z-direction.

As is clear from the figures, the finger 74 has a width varying along a length of the finger, i.e. along the x-direction. More particularly, a first portion 80 of the finger has a first varying width wf1 while a second portion 82 of the finger has a second varying width wf2. The first portion is closer to the bridge 58 than the second portion and the second portion is wider than the first portion, i.e. wf2>wf1. Further, a third portion 84 of the finger 74, comprising the first and second portions 80 and 82 and a portion extending there between, is tapered such that the width of the third portion is gradually decreasing along the length of the finger in a direction towards the bridge 58, i.e. a −x-direction, which is opposite the x-direction.

A gasketed plate heat exchanger constructed in accordance with the present invention comprises a compressed stack of heat exchanger plates 4, each two heat exchanger plates being separated by a gasket arrangement 6. In connection with assembly of the plate heat exchanger, each heat exchanger plate 4 is provided with a gasket arrangement, wherein the gasket 50 is arranged in the gasket groove 18 on the first side 8 of the heat exchanger plate and the attachment means 52 are arranged in engagement with the first and the second length edge portion 26 and 28, respectively, of the heat exchanger plate 4. More particularly, each of the attachment means 52 is so fastened to the heat exchanger plate 4 that the first and the second connection members 54 and 56, respectively, are arranged on the first side 8 of the heat exchanger plate 4, in a respective one of two neighboring valleys 36 of the edge portions 26 and 28. Further, the finger 74 is arranged on a second side (not shown), which is opposite to the first side 8, of the heat exchanger plate 4, in the ridge 34 arranged between the above mentioned neighboring valleys. Arranged like that, the first and second connection members and the finger together squeeze the heat exchanger plate 4 to attach the gasket 50 in the groove 18 thereof. This is illustrated in FIG. 2.

As is clear from the figures the ridge 34 and the finger 74 are so dimensioned that the finger occupies essentially the entire ridge resulting in a firm engagement between the heat exchanger plate 4 and the attachment means 52. Further, because of the widths of the ridge and the finger varying in the above described way, the attachment means is "locked" to the heat exchanger plate. More particularly, the attachment means is prevented from moving in relation to the heat exchanger plate in a direction parallel to an extension plane of the heat exchanger plate, i.e. the finger is prevented from sliding out of engagement with the ridge which could happen with some prior art attachment means.

Figure 5B:
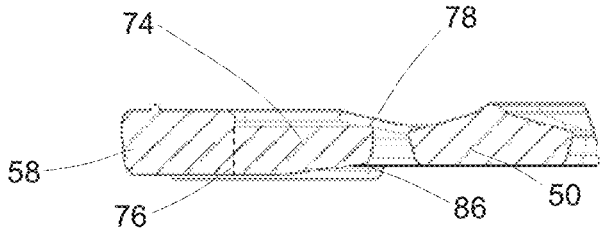
FIG. 5*b* is a cross section of the gasket arrangement, taken along line A-A in FIG. 5*a*.

As is illustrated in FIG. 5*b*, the finger 74 is tapered so as to be thicker at its first end 76 than at its free second end 78.

Thereby, when the attachment means is applied onto the heat exchanger plate, the finger may follow the heat exchanger plate more closely and thus engage stronger therewith. Further, the free second end 78 of the finger 74 is slightly chamfered at a surface 86 arranged to face away from the heat exchanger plate 4 when the gasket arrangement 6 is applied thereon. A purpose of the chamfering is to give the attachment means a less sprawling impression when fixed to the heat exchanger plate 4 since the finger 74 may not engage, depending on its stiffness and exact shape, with the second side of the heat exchanger plate along its entire extension. Another purpose of this chamfering is to make the finger less prone to engagement with an underlying external structure in connection with application of the attachment means onto the heat exchanger plate.

Another feature of the attachment means 52 is that the bridge 58 is thicker, and thus more rigid, than the finger 74 which facilitates application of the attachment means onto the heat exchanger plate.

Figure 5C:
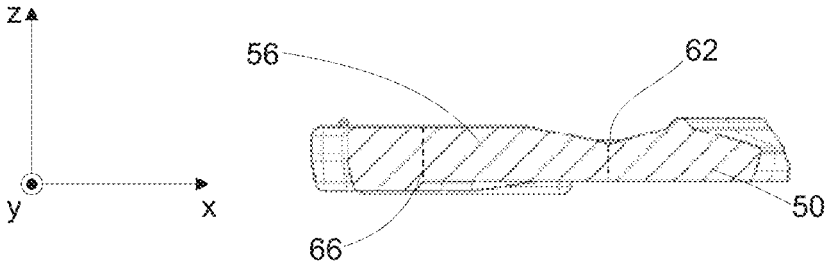
FIG. 5*c* is a cross section of the gasket arrangement, taken along line B-B in FIG. 5*a*.
Figure 5D:
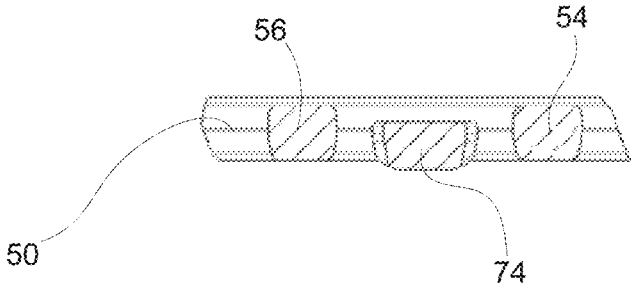
FIG. 5*d* is a cross section of the gasket arrangement, taken along line C-C in FIG. 5*a*.

As is most clearly illustrated in FIG. 5*c*, the gasket 50 is, at its connection to the first and second connection members 54 and 56, thinner than the first and second connection members are at their respective second ends 64 and 66, respectively. In order not to extend beyond the gasket, with the risk of affecting its sealing capacity when pressed against another heat exchanger plate, the first and second connection members are tapered such as to be less thick at their respective first ends 60 and 62 where they join the gasket 50.

Figure 6:
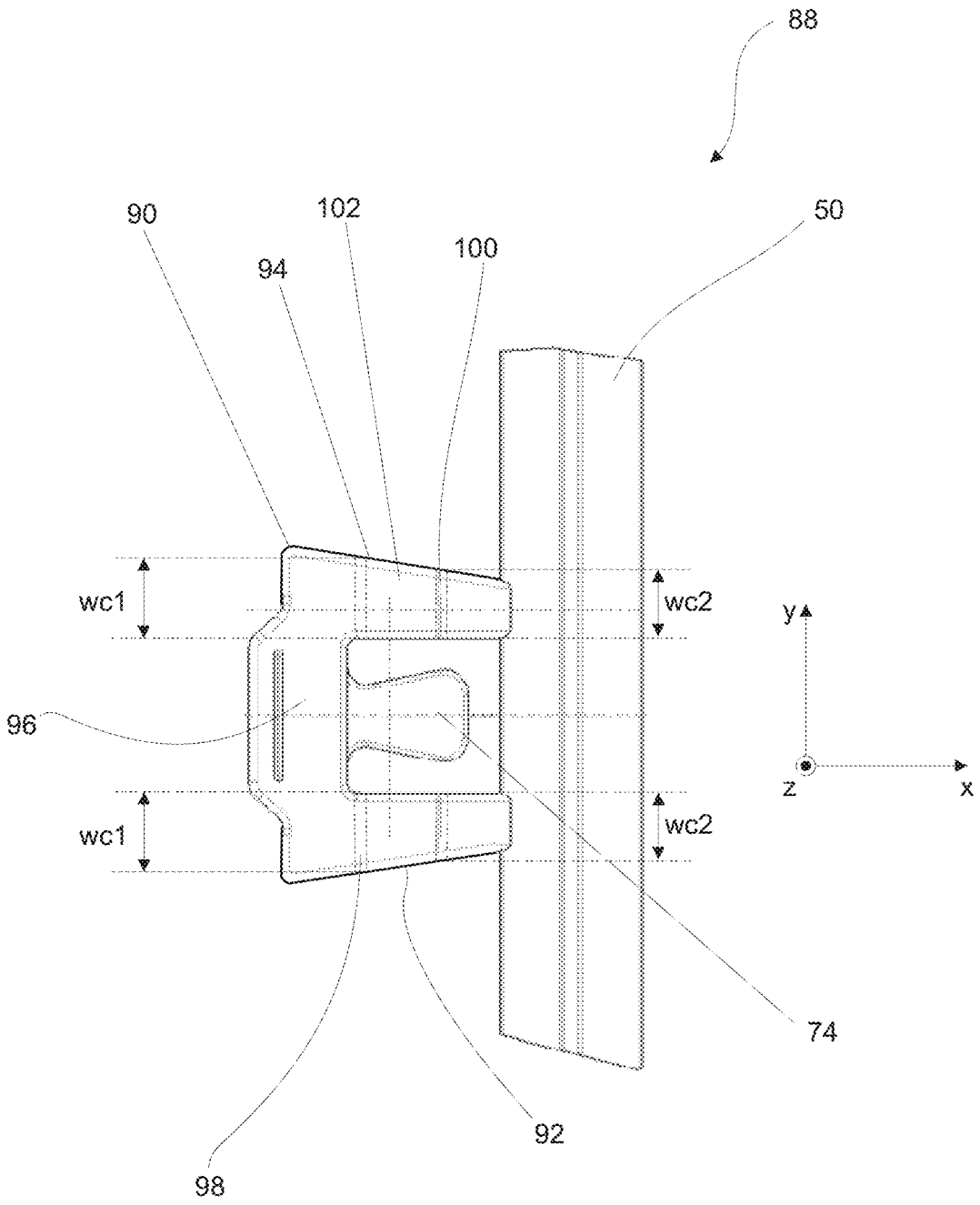
FIG. 6 is a partial plan view of an alternative gasket arrangement.

FIG. 6 illustrate an alternative gasket arrangement 88 adapted for engagement with the heat exchanger plate 4. The gasket arrangement 88 is in many ways similar to the gasket arrangement 6, and the same reference numerals have been used for parts of the two gasket arrangements that are similar. These similar parts will not be described again. The gasket arrangement 88 comprises a number of essentially similar rubber attachment means 90 integrally formed with the gasket, one of these attachment means being illustrated in more detail in FIG. 6. The attachment means 90 comprises a first connection member 92, a second connection member 94 and a bridge 96.

As is clear from FIG. 6, the connection members 92 and 94 each have a width varying along a length of the connection members, i.e. along the x-direction. More particularly, a respective first portion 98 of the connection members has a first varying width wc1 while a respective second portion 100 of the connection members has a second varying width wc2. The first portion is closer to the bridge 96 than the second portion and the first portion is wider than the second portion, i.e. wc1>wc2. Further, a respective third portion 102 of the connection members 92 and 94, comprising the first and second portions 98 and 100 and a portion extending there between, is tapered such that the width of the third portion is gradually decreasing along the length of the connection members in a direction from the bridge 96, the x-direction. As a result thereof, as is illustrated in FIG. 6, also the bridge 96, as well as the complete attachment means 90, is tapered, i.e. has a varying width, a width extension being parallel to a length direction of the bridge, i.e. the y-direction.

The above described embodiments of the present invention should only be seen as examples. A person skilled in the art realizes that the embodiments discussed can be varied in a number of ways without deviating from the inventive conception.

As an example, the above described gasket arrangements comprise a plurality of attachment means distributed along an outside of the gasket so as to engage with the first and second length edges of the heat exchanger plate. Naturally, one or more of the attachment means could also/instead be arranged to engage with a first and/or a second transverse edge and/or a port hole edge of the heat exchanger plate.

The present invention can be used in connection with alternative gasket designs, for example a gasket arranged to enclose the port holes once only, whereby the gasket could be essentially rectangular, or a ring gasket arranged to enclose one of the port holes only.

The attachment means need not comprise one finger only like above but could comprise any number of fingers, some or all having varying widths. In case of the attachment means comprising a plurality of fingers, the fingers could be arranged to engage alternately with the first and second sides of the heat exchanger plate. Accordingly, one or more fingers, with or without a varying width, could be arranged for engagement with a respective one of the valleys of the heat exchanger plate. Further, a finger arranged to engage with a valley, i.e. the first side, of the heat exchanger plate need not have a free second end but could instead have a second end arranged to engage with the gasket.

The gasket and the attachment means must not be integrally formed but could be two separate but connectable parts. Further, the gasket and attachment means need not be made of rubber but can be made of any suitable material. Further, the gasket and attachment means need not be of the same material.

The first and second connection members of the above attachment means extend from the bridge to the gasket but they could instead extend beyond the bridge and/or the gasket. Similarly, the finger could extend beyond the bridge and/or the gasket.

The assemblies according to the above embodiments are such that the gasket groove and the valleys of the length edge portions essentially are in the same plane. Naturally, alternative embodiments are possible where the gasket groove and the valleys are in different planes.

The finger and connection members as well as the bridge of the attachment means could be formed in an alternative way than above described. For example, the finger and/or the connection members need not extend parallel to each other and/or perpendicularly to the bridge. Also, the bridge need not extend essentially parallel to the gasket. Further, the finger and/or the connections elements need not be tapered in the z-direction and/or chamfered. Also, the finger may have a constant width along a part/parts of its length.

The above described attachment means 90 comprises connection members 92 and 94 having a varying width in that an outside of the connection members extend non-perpendicularly to the gasket 50 which gives also the attachment means 90 a varying width. Alternatively, an inside of the connection members could instead extend non-perpendicularly to the gasket 50 whereby the attachment means 90 could have an essentially constant width. Further, both an inside and an outside of the connection members could extend non-perpendicularly to the gasket 50.

The ridges and valleys of the heat exchanger plate above are all similar but this is not a requirement. Alternatively, only the ridges and/or the valleys arranged for engagement with an attachment means could have a varying width, or only the ridges and/or the valleys arranged for engagement with the fingers of the attachment means could have a varying width, while the rest of the ridges and/or the valleys could have an essentially constant width.

The friction increasing structure of the bridge need not be formed as an elongate projection but can be formed in other ways, for example as a ribbed or rough surface portion.

Further, the surface provided with this friction increasing structure need not be the upper surface of the bridge but could be another surface thereof.

The present invention could be used in connection with other types of heat exchanger plates than the above described one. Such other plate types could be made of other materials than stainless steel, be provided with a gasket groove of an alternative design or no gasket groove at all, be provided with another pattern, another port hole design or another number of port holes than four.

Finally, the present invention could be used in connection with other types of plate heat exchangers than purely gasketed ones, e.g. plate heat exchangers comprising permanently joined heat exchanger plates.

It should be stressed that the attributes first, second, third, etc. is used herein just to distinguish between species of the same kind and not to express any kind of mutual order between the species.

It should be stressed that a description of details not relevant to the present invention has been omitted and that the figures are just schematic and not drawn according to scale. It should also be said that some of the figures have been more simplified than others. Therefore, some components may be illustrated in one figure but left out on another figure.

The present invention could be combined with the invention described in applicant's copending European patent application titled "HEAT TRANSFER PLATE AND PLATE HEAT EXCHANGER" filed on the same day as the present European patent application, and the invention described in applicant's copending patent application EP13153167.5.

The invention claimed is:

1. A heat exchanger plate comprising, on a first side thereof:

a gasket groove extending along an edge of the heat exchanger plate; and an edge portion of the heat exchanger plate extending between the edge and the gasket groove and being corrugated so as to comprise alternately arranged ridges and valleys as seen from the first side; and wherein the edge portion is arranged to engage with a connector for fastening a gasket in the gasket groove, wherein a width extension of the ridges and valleys is parallel to a length extension of the gasket groove, wherein at least one of the ridges and valleys has a width that varies along a length of said at least one of the ridges and valleys, a first portion of said at least one of the ridges and valleys having a first width and a second portion of said at least one of the ridges and valleys having a second width, the first portion being arranged closer to the gasket groove than the second portion, and the first width being larger than the second width, and wherein said at least one of the ridges and valleys is closed towards the gasket groove.

2. The heat exchanger plate according to claim 1, wherein a third portion of said at least one of the ridges and valleys is tapered along the length of said at least one of the ridges and valleys in a direction from the gasket groove.

3. The heat exchanger plate according to claim 1, wherein said at least one of the ridges and valleys is one of the ridges and wherein at least one of the valleys has a width that varies along a length of said at least one of the valleys.

* * * * *